US007565794B2

(12) United States Patent
Eroglu et al.

(10) Patent No.: US 7,565,794 B2
(45) Date of Patent: Jul. 28, 2009

(54) PREMIX BURNER FOR A GAS TURBINE COMBUSTION CHAMBER

(75) Inventors: Adnan Eroglu, Untersiggenthal (CH); Majed Toqan, Abu Dhabi (AE)

(73) Assignee: ALSTOM Technology Ltd., Baden (CH)

( * ) Notice: Subject to any disclaimer, the term of this patent is extended or adjusted under 35 U.S.C. 154(b) by 0 days.

(21) Appl. No.: 11/860,581

(22) Filed: Sep. 25, 2007

(65) Prior Publication Data

US 2008/0115497 A1 May 22, 2008

Related U.S. Application Data

(63) Continuation of application No. PCT/EP2006/061144, filed on Mar. 29, 2006.

(30) Foreign Application Priority Data

Mar. 31, 2005 (DE) ..... 10 2005 015 152

(51) Int. Cl.
*F23R 3/30* (2006.01)

(52) U.S. Cl. ..... 60/39.463; 60/737

(58) Field of Classification Search ..... 60/39.463, 60/737, 738, 776; 431/354
See application file for complete search history.

(56) References Cited

U.S. PATENT DOCUMENTS 5,307,634 A 5/1994 Hu
5,822,992 A * 10/1998 Dean ..... 60/737
6,270,338 B1 * 8/2001 Eroglu et al. ..... 431/354
2003/0150217 A1 8/2003 Gutmark et al.

FOREIGN PATENT DOCUMENTS

DE 4445279 6/1996

(Continued)

OTHER PUBLICATIONS

Search Report for German Patent App. No. 10 2005 015 152.3 (Apr. 18, 2005).

(Continued)

*Primary Examiner*—Louis J Casaregola
(74) *Attorney, Agent, or Firm*—Cermak Kenealy Vaidya & Nakajima LLP; Adam J. Cermak

(57) ABSTRACT

A burner (1) for a combustion chamber of a gas turbine, especially in a power plant, includes an oxidizer feed device (10) for feeding a gaseous oxidizer into a mixer chamber (3) of the burner (1), a gaseous fuel feed device (11) for feeding a gaseous fuel into the mixer chamber (3), and a liquid fuel feed device (12) for feeding a liquid fuel into the mixer chamber (3). In order to improve the operation of the burner (1) with liquid fuel, the liquid fuel feed device (12) has a main feed line (13) which feeds liquid fuel to a plurality of injection orifices (14). Some of these injection orifices (14), with regard to a main outflow direction (9) of the burner (1), which has an oxidizer-fuel mixture, which flows from the mixer chamber (3), at an outlet opening (5) of the mixer chamber (3), are arranged in series. Some or all of these injection orifices (14) are designed so that a main injection direction (15) of the respective injection orifice (14) has a radial component which extends radially to the main outflow direction (9).

14 Claims, 5 Drawing Sheets

FOREIGN PATENT DOCUMENTS

| | | |
|---|---|---|
| DE | 10164099 | 7/2003 |
| DE | 10160907 | 8/2003 |
| DE | 10205839 | 8/2003 |
| DE | 10334228 | 3/2004 |
| EP | 0433790 | 6/1991 |
| EP | 1292795 | 3/2003 |
| WO | WO95/16881 | 6/1995 |
| WO | WO01/96785 | 12/2001 |
| WO | WO2006/103257 | 10/2006 |

OTHER PUBLICATIONS

International Search Report for PCT Patent App. No. PCT/EP2006/061144 (Jun. 20, 2006).

* cited by examiner

PREMIX BURNER FOR A GAS TURBINE COMBUSTION CHAMBER

This application is a Continuation of, and claims priority under 35 U.S.C. § 120 to, International application number PCT/EP2006/061144, filed 29 Mar. 2006, and claims priority therethrough under 35 U.S.C. § 119 to German application number No 10 2005 015 152.3, filed 31 Mar. 2005, the entireties of which are incorporated by reference herein.

BACKGROUND

1. Field of Endeavor

The invention relates to a premix burner for a combustion chamber of a gas turbine, especially in a power plant, at least having a housing defining a mixer chamber, an oxidator feed device for feeding a gaseous oxidator into the mixer chamber, a gaseous fuel feed device for feeding a gaseous fuel into the mixer chamber, and also a liquid fuel feed device for feeding a liquid fuel into the mixer chamber.

2. Brief Description of the Related Art

A premix burner of the type referred to above is known from EP 0 433 790. The generic type burner has a housing which is built from a plurality of internesting shells and which encloses a mixer chamber. By the offset arrangement of the half-shells, slots are formed for tangential feeding of an oxidator, especially combustion air, into the mixer chamber. Due to the tangential combustion air inlet, a swirled flow is formed in the mixer chamber and becomes unstable at the burner outlet due to a cross sectional jump, and changes into an annular swirled flow with a backflow in the core. This backflow enables the stabilization of a flame front downstream of the burner outlet. Injectors for injecting a gaseous fuel into the combustion air are provided inside the inlet slots for the combustion air. This injection, in conjunction with the turbulent swirled flow inside the mixer chamber, leads to a good mixing through of the gaseous fuel with the combustion air. A good mixing through in such burners is one of the preconditions for low NOx emissions during combustion. Furthermore, the burner is equipped with a central lance for feed of a liquid fuel, which extends from the burner head into the mixer chamber. The lance on its free-standing axial end has an injection orifice through which the liquid fuel is injectable into the mixer chamber and also into the combustion space of a combustion chamber, which combustion space is arranged downstream of the mixer chamber.

In the generic type burner, injection of the liquid fuel into the mixer chamber is carried out parallel to the burner axis, and injection of the gaseous fuel into the combustion air is carried out parallel to its flow direction. As a result, the characteristics of injection with regard to penetration depth and mixing in of the fuel jets, and also the fuel distribution along the combustion air inlet slots and also along the burner axis, are specified. The arrangement of the outlet orifices establishes the mixing qualities of fuel and combustion air, and also fuel distribution at the burner outlet. However, these variables significantly influence the NOx emissions and the quenching limit of the burner, and also its stability with regard to combustion pulsations.

The partial load range is problematical during operation of premix burners, especially such burners in connection with gas turbine plants, since in this case only comparatively low quantities of fuel are added to the combustion air. With complete mixing of the fuel with all the combustion air, however, a mixture results which even in the low partial load range is no longer ignitable, or only forms a very unstable flame. This leads to unwanted combustion pulsations or to a possible quenching of the flame.

A possibility for reducing these disadvantageous effects is to feed all the required quantity of fuel via the central lance. The burner is then operated at very high air ratios as a diffusion burner. On the one hand, a very high flame stability, but, on the other hand, also very high NOx emissions, result from this.

A further development of the burner which is discussed above is the subject of EP 1 292 795, which discloses a burner which, even during changes of load or changes of fuel quality, can be stably operated with approximately constantly low emission values. This premix burner includes a housing, which has one or more shells, a mixer chamber, into which combustion air is injected via tangentially arranged slots and which changes into a swirled flow in the mixer chamber, and means for introducing fuel into the combustion air flow, wherein this means has a first group of fuel outlet orifices for a first fuel, which are basically oriented parallel to the burner axis, and at least one second group of fuel outlet orifices for a second fuel, which are basically oriented parallel to the burner axis, wherein the first and the second group are subjectable to fuel admission independently of each other, and the means is preferably arranged in the region of the combustion air inlet slots.

For further increasing of the flame stability, pilot fuel can be additionally introduced via a lance.

Since the burner can be exclusively operated with liquid fuel, the possibility arises of maintaining or repairing the gaseous fuel feed device without the operation of the burner or of the combustion chamber having to be completely interrupted for this purpose. This is advantageous for the efficiency of the gas turbine which is equipped with it. As already mentioned elsewhere, however, injection of liquid fuel into the mixer chamber of the burner or into the combustion space of the combustion chamber, as the case may be, customarily leads to appreciably increased flame temperatures, which, for example, is to be ascribed to inadequate atomization, mixing and evaporation of the liquid fuel before its ignition. Increased flame temperatures, however, are associated with a disproportionally increased production of NOx emissions and soot. This disadvantage can be minimized somewhat by water, or water vapor, being admixed with the liquid fuel, for example in a quantity ratio of 1:1, and, instead of liquid fuel, a fuel/water emulsion consequently being injected into the mixer chamber, which leads to a delay of the combustion reaction and to a lowering of the local flame temperatures. In this case, it is again disadvantageous that the feed of such a thinning medium increases the heat transfer in the turbine on the hot gas side, which is accompanied by a reduction of the service life of the turbine. Furthermore, there are sites for power plants in which water is too expensive to be used as a thinning medium. Furthermore, the comparatively short time in which the burner is actually operated with liquid fuel is taken into account, so during a service of the gaseous fuel feed device, or in pilot mode, the costs for preparation of the water, for example dimineralization plants have to be made available for this, are therefore too high.

SUMMARY

One of numerous aspects of the present invention is based on an improved embodiment for a generic type burner, which is especially comparatively cost-effectively realizable and at the same time enables a reduction of NOx emissions and also of soot formation.

For operation of the generic type burner with liquid fuel, yet another aspect of the present invention involves injecting liquid fuel into the mixer chamber via a plurality of injection orifices which, with regard to a main outflow direction of the burner, are arranged in series, and which inject the liquid fuel with a main injection direction which has a radial component which extends radially to the main outflow direction, wherein a direction which has the oxidator(oxidizer)-fuel mixture, which flows from the mixer chamber, at the outlet opening of the mixer chamber is to be understood by the main outflow direction of the burner. By this type of construction, the injection of liquid fuel is distributed to a plurality of injection orifices, as a result of which the volumetric flow at the individual injection orifice is reduced. In this way, the atomization action of the individual injection orifices can be improved. At the same time, an improved mixing and also an improved evaporation of the liquid fuel ensues as a result. It inevitably results from the arrangement of the injection orifices in series and parallel to the main outflow direction that some of the injection orifices are relatively far from the outlet opening of the mixer chamber. The liquid fuel which is injected there, therefore, has an increased retention time in the mixer chamber, which is favorable to the mixing through and evaporation of the fuel. Furthermore, the radial component of the main injection direction at the respective injection orifice is especially advantageous for the mixing through and evaporation. This measure, then, intensifies the mixing through and evaporation of the liquid fuel.

Because of the construction according to principles of the present invention, therefore, a significant improvement of the atomization, the mixing through, and the evaporation of the liquid fuel ensues. On the one hand, this delays the ignition of the liquid fuel, and, on the other hand, reduces the risk of locally excessive flame temperatures. As a consequence, the NOx formation is reduced; furthermore, less soot results. Of particular advantage in this case is that the described improvement of the emission values can be achieved without water, or water vapor, or another thinning medium having to be fed to the liquid fuel for this purpose. As a consequence, the burner according to the invention requires no water for operation with liquid fuel. The water portion in the liquid fuel (so-called "ω-value"), therefore, is low and is preferably zero. Since no such thinning medium is required for operation of the burner with liquid fuel, corresponding systems for preparation of such a thinning medium are also dispensed with. The costs for realizing such a burner, therefore, are comparatively low.

In a preferred embodiment, the burner can be equipped with a centrally arranged lance which extends from a burner head into the mixer chamber. Some or all of the injection orifices can then be provided on this lance, wherein the injection orifices are then arranged in a distributed manner in the main outflow direction that is in the longitudinal direction of the lance along the lance over its generated surface. The liquid fuel can be already injected into the mixer chamber relatively close to the burner head accordingly.

This lance can be additionally or alternatively equipped with at least one pilot injection orifice, via which, for a pilot mode, liquid fuel is injected into the mixer chamber or into a combustion space of the combustion chamber, which combustion space is arranged downstream of the mixer chamber. The at least one pilot injection orifice in this case injects the liquid fuel with a main injection direction which basically exclusively has an axial component and so extends parallel to the main outflow direction. The at least one pilot injection orifice is expediently axially arranged on the free end, that is on the tip of the lance.

In an alternative advantageous embodiment, some or all of the fuel injection orifices are arranged along the at least one tangential inlet opening for the oxidator. The adding of the liquid fuel in this embodiment is carried out inside the tangential inlet opening of the mixer chamber, or directly upstream of it. This injection, in conjunction with the turbulent swirled flow inside the mixer chamber, leads to an intensive mixing through of fuel and oxidator. At the same time, the retention time of the injected liquid fuel is extended as a result of this, which also improves the mixing through and in particular the evaporation of the liquid fuel.

A development in which the liquid fuel feed device has at least one liquid fuel passage, which is connected to the main feed line for liquid fuel, which leads to some or all of the injection orifices and which is formed in a tube which extends along the at least one tangential inlet opening and is arranged upstream of the respective inlet opening with regard to the oxidator flow, is now especially advantageous. The injection of liquid fuel via such a tube enables an optimum distribution of the injection of liquid fuel along the respective inlet opening. This also boosts atomization, mixing through, and evaporation of the liquid fuel.

For operation of the burner with gaseous fuel, in a special development, the tube can additionally be used for also feeding the gaseous fuel to the oxidator flow via the tube upstream of the respective inlet opening. For this purpose, the tube includes at least one gaseous fuel passage in addition to the liquid fuel passage. The gaseous fuel which is injected at this point, therefore, also has an especially long retention time in the burner, which intensifies the mixing through with the oxidator flow. The integration of the liquid fuel passage and of the at least one gaseous fuel passage in a common tube reduces in this case the production costs of the burner.

Further important features and advantages of the burner according to principles of the present invention can be learned from the drawings and from the associated description of the figures with reference to the drawings.

BRIEF DESCRIPTION OF THE DRAWINGS

Preferred exemplary embodiments of the invention are represented in the drawings and are explained in detail in the subsequent description, wherein like designations refer to the same or similar, or functionally the same, components. In the drawing, schematically in each case.

DETAILED DESCRIPTION OF EXEMPLARY EMBODIMENTS

Figure 1:
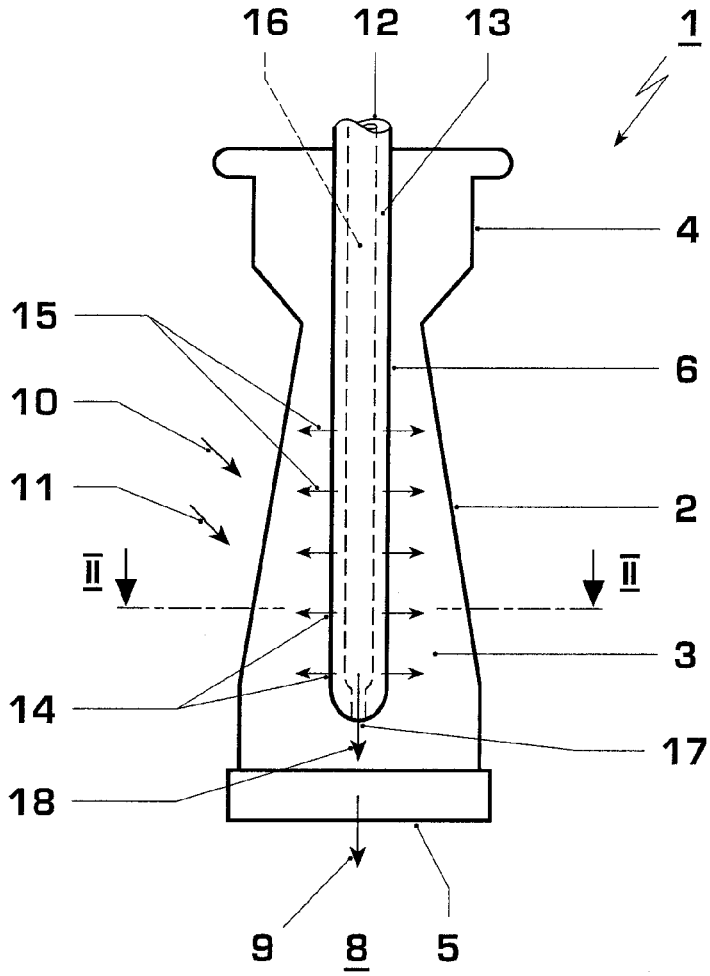
FIG. 1 shows a much simplified basic longitudinal section through a burner according to the invention.
Figure 2:
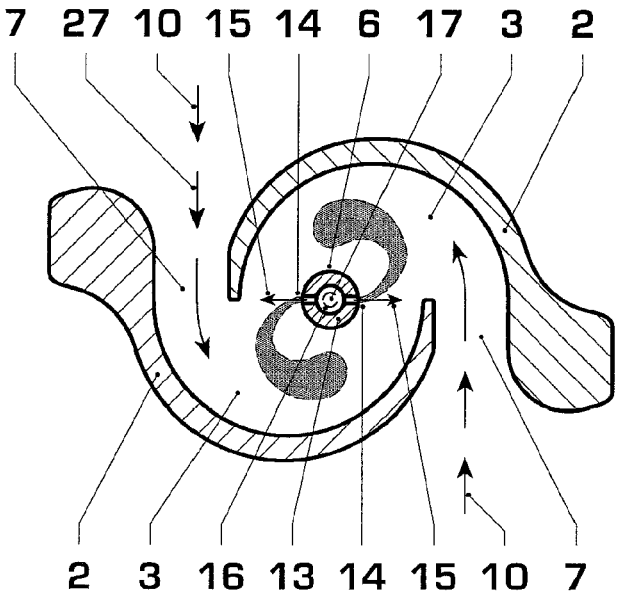
FIG. 2 shows a cross section through the burner according to FIG. 1, corresponding to intersection lines II-II.

Corresponding to FIGS. 1, 3, 5, and 8, a burner 1 according to the invention includes a mixer chamber 3 which is defined by a housing 2. Furthermore, the burner 1 has a burner head 4 which is arranged opposite an outlet opening 5 of the mixer chamber 3. In the embodiments which are shown here, a lance 6 is attached to the burner head 4 and projects centrally into the mixer chamber 3. The lance 6 in this case can be arranged on the burner head 4 in a withdrawable or retractable manner, so that to a certain extent it is retracted into the mixer chamber 3 only when required.

According to FIGS. 2, 4, 6, 7, 9, and 10, the housing 2 in the embodiments which are shown here is designed so that the mixer chamber 3 has two inlet openings 7 for the oxidator. These inlet openings 7 in this case are arranged and designed so that a tangential inflow, and therefore a concentric vortex system, is formed for the mixer chamber 3. This is achieved in this case by a half-shell type of construction of the housing 2, wherein the half-shells in their parting plane are arranged in an offset manner eccentrically to each other with regard to a longitudinal center axis of the housing 2. Furthermore, the housing 2 is basically conically formed, with a cross section which widens towards the outlet opening 5. However, the conical form of the housing 2 is not compulsory. It can also be cylindrically formed, wherein it is expedient with such an embodiment of the housing 2 to arrange a conically tapering inner body inside the mixer chamber 3, as this is explained in detail in EP 1 292 795 which is quoted in the introduction.

The burner 1 serves for supply of a combustion chamber, which is not shown, of a gas turbine, especially in a power plant, with an oxidator-fuel mixture. For this purpose, the burner 1 is connected to the combustion chamber, and in fact so that the outlet opening 5 leads to a combustion space 8 of the combustion chamber. In this case, the oxidator-fuel mixture at the outlet opening 5 has a main outflow direction 9 which extends parallel to the longitudinal direction of the mixer chamber 3 and which is basically perpendicular to the outlet opening 5.

Figure 3:
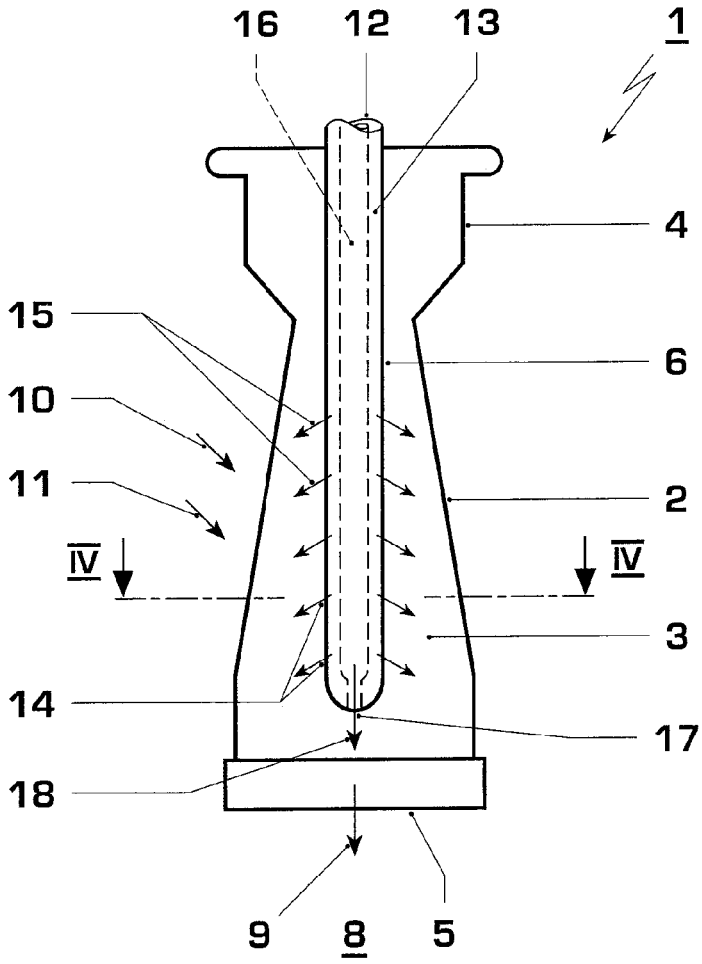
FIG. 3 shows a longitudinal section as in FIG. 1, however in another embodiment.

The burner 1 is equipped with an oxidator feed device 10 which, in FIGS. 1, 3, 5, and 8, is symbolized by an arrow. The oxidator feed device 10 serves for feeding a gaseous oxidator, as a rule air, into the mixer chamber 3. Furthermore, the burner 1 is equipped with a gaseous fuel feed device 11 which in FIGS. 1 and 3 is also symbolized by an arrow. The gaseous fuel feed device 11 serves for feeding a gaseous fuel, like, for example, natural gas, into the mixer chamber 3. Customarily, the burner 1 for the most part is operated with the gaseous fuel. A burner 1 embodying principles of the present invention, however, is also designed for an operation with liquid fuel, like, for example, diesel oil. For this purpose, the burner 1 additionally has a liquid fuel feed device 12, by which liquid fuel can be introduced into the mixer chamber 3.

According to the invention, this liquid fuel feed device 12 is now equipped with at least one main feed line 13 which feeds the liquid fuel to a plurality of injection orifices 14. The liquid fuel can be introduced into the mixer chamber 3 through these injection orifices 14. In this case, the injection orifices 14 are arranged or distributed so that at least some of the injection orifices 14 are arranged in at least one row with regard to the main outflow direction 9. Furthermore, it is especially important that the individual injection orifices 14 in this case are designed so that a main injection direction 15 of the respective injection orifice 14, which is symbolized here by an arrow in each case, has a radial component which extends radially to the main outflow direction 9. In this case, that direction which has an injection jet with or without swirl in the medium is understood as "the main injection direction".

By this construction or by this design and arrangement of the injection orifices 14, as the case may be, an arrangement of injection orifices 14 which are distributed in the longitudinal direction of the mixer chamber 3 results. This is advantageous for achieving an improved atomization, mixing through and evaporation of the injected liquid fuel.

Figure 5:
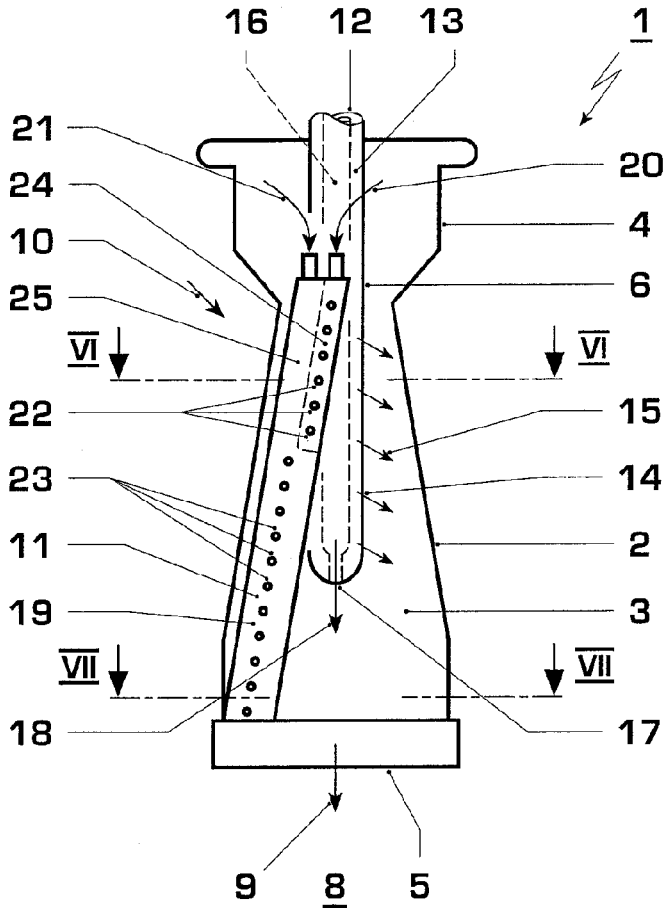
FIG. 5 shows a longitudinal section as in FIG. 1, however in another embodiment.

In the embodiments of FIGS. 1, 3, and 5, the injection orifices 14 are formed on the lance 6, as a result of which injection of the liquid fuel into the swirled flow, which is formed due to the tangential feed of the oxidator in the mixer chamber 3, to a certain extent is carried out from inside. The main feed line 13 for the liquid fuel extends at least partially inside the lance 6 accordingly.

The injection orifices are preferably arranged parallel to the main outflow direction 9 in more than one row, for example in two diametrically oppositely disposed rows. According to FIG. 2, the injection orifices 14 for example lie in the parting plane of the two housing half-shells, inside which the two housing half-shells are arranged in an offset manner eccentrically to each other and form the slotted inlet openings 7.

The number of rows of injection orifices 14 expediently corresponds to the number of inlet openings 7 of the mixer chamber 3. In this way, each group of injection orifices 14 can be specially associated with an inlet opening 7. However, this is not compulsory. A greater or lesser number of rows of injection orifices 17 can just as well be arranged, or the rows can be offset upstream or downstream in relation to the inlet opening 7.

While the injection orifices 14 which are provided in two oppositely disposed rows, according to the views in FIGS. 1 to 4, are arranged in pairs in the same longitudinal plane in each case, the injection orifices of the opposite rows can also be offset in relation to each other. In this case, the series-arranged injection orifices 14 of each row preferably have a uniform spacing in relation to each other.

In the embodiment according to FIG. 1, the injection orifices 14 are designed in each case so that the main injection direction 15 exclusively has a radial component in each case, that is to say the main injection direction 15 extends perpendicularly to the main outflow direction 9.

In one development, the liquid fuel feed device 12 can be optionally equipped with a pilot feed line 16, by which liquid fuel can be fed to at least one pilot injection orifice 17. In contrast to the remaining injection orifices 14, the at least one pilot injection orifice 17 is designed so that it has a main injection direction 18, which is indicated by an arrow, which exclusively has an axial component which extends parallel to the main outflow direction 9. In pilot mode of the burner 1, therefore, liquid fuel can be injected axially, that is parallel to the main outflow direction 9, with or without swirl into the mixer chamber 3, or directly into the combustion chamber 8, as the case may be. The at least one pilot injection orifice 17 is preferably arranged on the lance 6, and in fact preferably on the lance tip, that is on an end of the lance 6 which is distanced from the burner head 4.

Corresponding to the embodiments of FIGS. 3 and 5, the injection orifices 14 can also be expediently designed so that in addition to the radial component their respective main injection direction 15 also has an axial component which consequently extends parallel to the main outflow direction 9. In this way, for example the mixing through with the oxidator flow can be improved.

Figure 4:
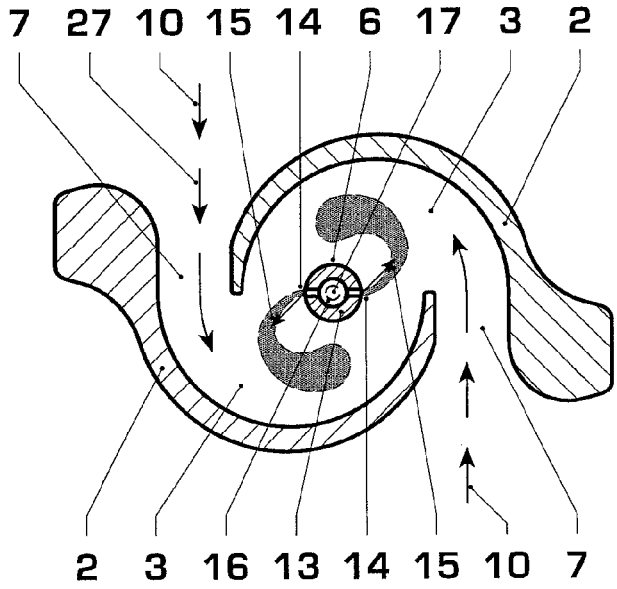
FIG. 4 shows a cross section through the burner according to FIG. 3, corresponding to intersection lines IV-IV.
Figure 6:
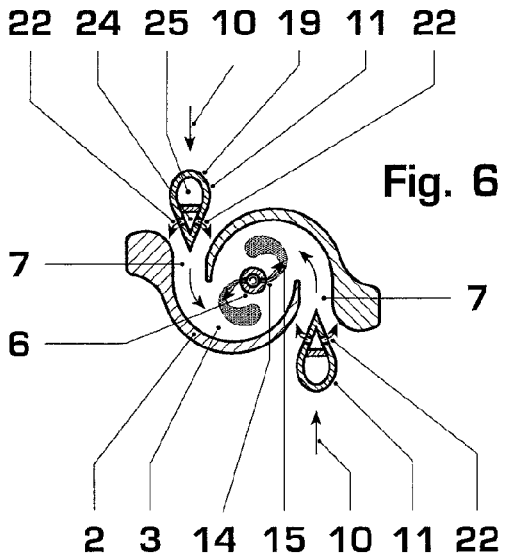
FIG. 6 shows a cross section through the burner according to FIG. 5, corresponding to intersection lines VI-VI.
Figure 7:
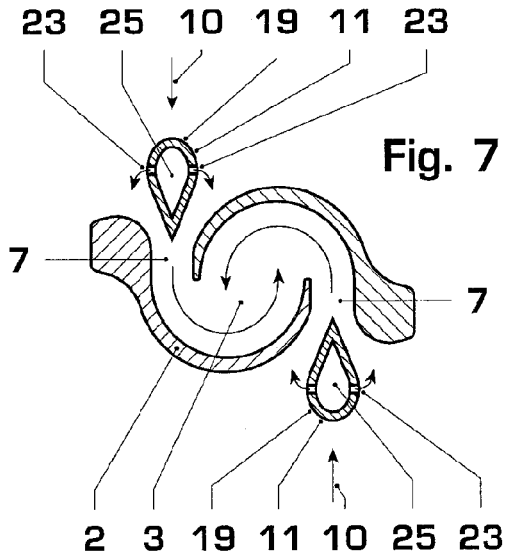
FIG. 7 shows a cross section through the burner according to FIG. 5, corresponding to intersection lines VII-VII.

Corresponding to FIGS. 4 and 6, the injection orifices 14 can also be designed so that the respective main injection direction 15 can also have a circumferential component in addition to the radial component. This circumferential component, or tangential component, in this case extends transversely to the main outflow direction 9, and also transversely to the radial component. In this case, this circumferential component is expediently oriented in the rotational direction of the swirled flow which is formed as a result of the tangential inflow of the oxidator in the mixer chamber 3. The circumferential component can also contribute to improvement of mixing through of the liquid fuel with the oxidator. In this case, it is clear that the injection orifices 14 can be designed so that the main injection direction 15 cumulatively or alternatively has the axial component and the circumferential component in addition to the radial component.

For arranging, positioning, and dimensioning of the injection orifices 14, and also for orienting of their main injection direction 15, an optimum is expediently sought which leads to an especially good atomization, mixing through, and evaporation of the liquid fuel in the oxidator gas. For this purpose, it can be especially also necessary to design the individual injection orifices 14 differently with regard to orifice cross section and/or main injection direction and/or mutual spacing, in order to be able to optimally adapt each individual injection orifice to the locally prevailing flow conditions in the extreme case. Furthermore, it is clear that the injection orifices 14 must have a defined ratio of length to diameter in order to be able to properly present the desired main injection direction in each case. It is quite possible that in this case it becomes necessary to select the wall thickness of the lance 6 greater than is the case, for example, with a conventional lance 6 for injecting liquid fuel.

Figure 8:
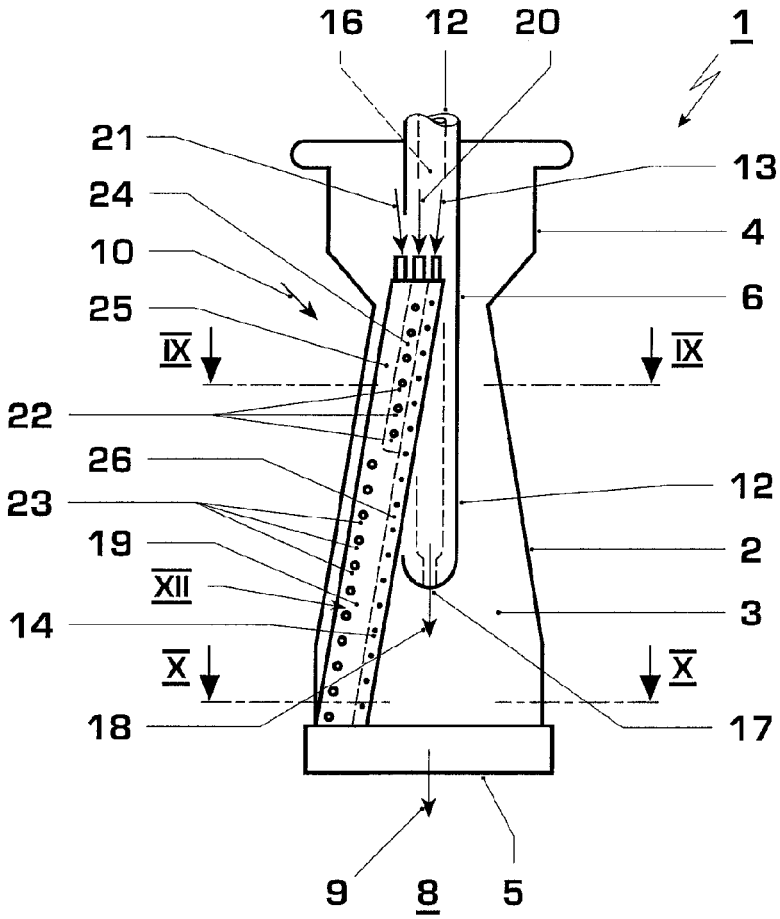
FIG. 8 shows a longitudinal section as in FIG. 1 however in another embodiment.

In the embodiments of FIGS. 5 and 8, a tube 19 is associated with each inlet opening 7, see also FIGS. 6, 7 and 9, 10 concerning this. The tubes 19 in this case are arranged inside the inlet opening 7, or upstream of the associated inlet opening in each case with regard to the oxidator flow, and to a certain extent extend parallel along the entire respective inlet opening 7. The tubes 19 in this case are not expediently provided with a circular cross section, but have a rounded oblong profile, an oval profile or a streamlined profile in conformance with the space conditions and flow conditions inside or directly upstream of the inlet opening 7.

The gaseous fuel feed device 11 in these embodiments includes at least one feed line; two feed lines are provided in the present case, specifically a first feed line 20 and a second feed line 21. By the feed lines 20, 21, gaseous fuel can be fed to a plurality of injection orifices 22, 23. In this case, first injection orifices 22 are supplied by the first feed line 20, while second injection orifices 23 are supplied by the second feed line 21. The injection orifices 22, 23 in this case are arranged upstream of the respective inlet opening 7 with regard to the oxidator flow. The respective tube 19 in this case includes at least one gaseous fuel passage which is connected to the respective feed line 20, 21 and which leads to the associated injection orifices 22, 23 in each case. In the present case, a first gaseous fuel passage 24 is thus included in each tube 19 and connects the first feed line 20 to the first injection orifices 22 in a communicating manner. In a corresponding way, each tube 19 also includes a second gaseous fuel passage 25 which connects the second feed line 21 to the second injection orifices 23 in a communicating manner.

In the embodiments which are shown here, the first injection orifices 22 are arranged in a first longitudinal section of the mixer chamber 3, which section is at a distance from the outlet opening 5 and adjacent to the burner head 4, and consequently form a first burner stage. In contrast to this, the second injection orifices 23 are arranged in a second longitudinal section of the mixer chamber 3, which section is adjacent to the outlet opening 5, and consequently form a second burner stage which is arranged downstream of the first burner stage with regard to the main outflow direction 9. Via the separate feed lines 20, 21, the two burner stages can be controlled independently of each other. In this respect, in the embodiments of FIGS. 5 and 8 it concerns a two-stage burner 1.

Inside each tube 19, both the first group of injection orifices 22 and the second group of injection orifices 23 are arranged separately in each case in at least one row which basically extends along the respective inlet opening 7.

In the embodiments of FIGS. 5 and 8, the feed of gaseous fuel is carried out via the tubes 19, that is, upstream of the inlet openings 7 with regard to the oxidator flow. Furthermore, in these embodiments, liquid fuel as pilot injection can be injected via the lance 6 and through the at least one pilot injection orifice 17.

In the embodiments according to FIG. 5, the liquid fuel can be injected into the mixer chamber 3 from inside through the injection orifices 14 which are provided on the lance 6. In contrast to this, in the embodiment of FIG. 8 the injection orifices 14 are not provided on the lance 6 but are also provided on the at least one tube 19 so that the injection orifices 14 are then located upstream of the respective inlet opening 7 with regard to the oxidator flow. Injection of the liquid fuel is then carried out upstream of the respective inlet opening 7 with regard to the oxidator flow.

For this purpose, the tube 19 additionally includes a liquid fuel passage 26 which extends parallel to the gaseous fuel passages 24, 25. The liquid fuel passage 26 creates a communicating connection between the main feed line 13 and the injection orifices 14. The integration of the injection orifices 14 into the tube 19 gives rise to an especially simple construction for the burner 1 which can be operated both with gaseous fuel and with liquid fuel. At the same time, an especially large retention time for the liquid fuel in the mixer chamber 3 ensues with this type of injection of liquid fuel, as a result of which atomization, mixing through, and evaporation of the liquid fuel is improved.

In this case, it is clear that in another embodiment the at least one tube 19 can exclusively include the liquid fuel passage 26, wherein introducing of the gaseous fuel can then be carried out by a separate tube or in an optional other suitable manner.

Figure 9:
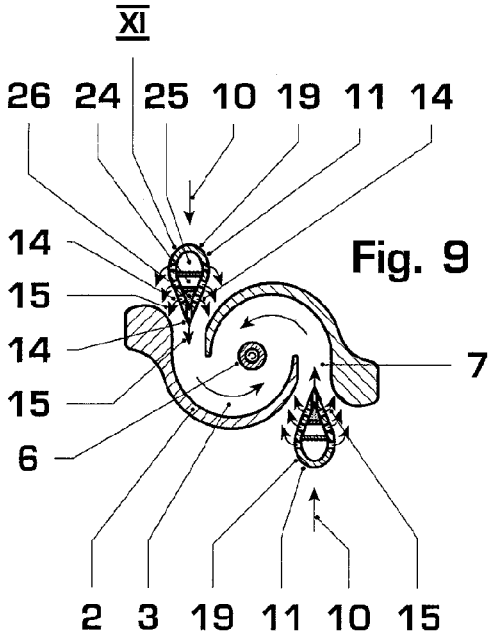
FIG. 9 shows a cross section through the burner according to FIG. 8, corresponding to intersection lines IX-IX.
Figure 10:
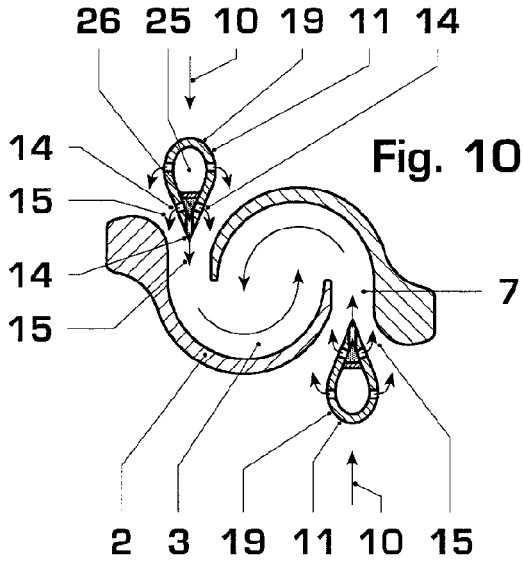
FIG. 10 shows a cross section through the burner according to FIG. 8, corresponding to intersection lines X-X.
Figure 11:
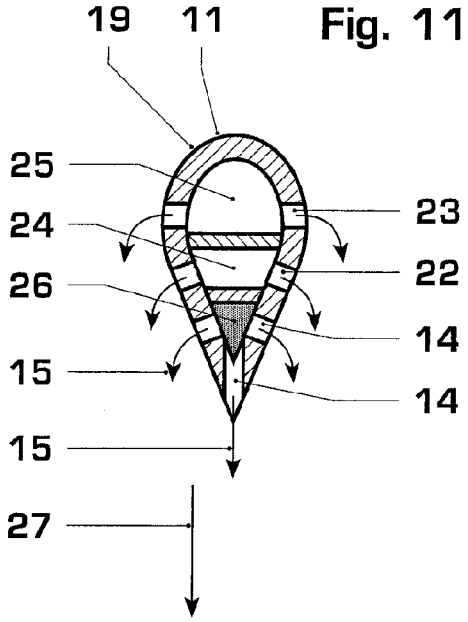
FIG. 11 shows an enlarged view of a detail XI from FIG. 9.

Corresponding to FIGS. 9 and 11, the tube 19 has a three-chamber construction in the region of the first gaseous fuel passage 24, wherein each chamber forms one of the passages 24, 25, 26. The section for the view according to FIG. 11 in this case is selected so that a pair of oppositely disposed first injection orifices 22, which communicate with the first gaseous fuel passage 24, a pair of oppositely disposed second injection orifices 23 communicate with the second gaseous fuel passage 25, and a plurality of injection orifices 14 which communicate with the liquid fuel passage 26, are apparent.

In this case, it is apparent that here again a plurality of injection orifices 14 are also assembled to form groups in each case, which are arranged one behind the other in a row parallel to the main outflow direction 9 in each case. In this case, all the injection orifices 14 are designed in each case so that their respective main injection direction 15 has a radial component with regard to the main outflow direction 9 of the burner 1. Furthermore, a plurality of injection orifices 14 are arranged along an outflow edge of the tube 19, and in this case are designed so that their respective main injection direction 15 extends parallel to a main inflow direction of the burner 1. This main inflow direction is symbolized by an arrow and designated with 27 in FIG. 11. The main inflow direction 27 has the oxidator flow, which flows into the mixer chamber 3, at the respective inlet opening 7. Furthermore, two rows of injection orifices 14 are provided here, which are designed in each case so that their respective main injection direction 15 has a transverse component with regard to the main inflow direction 27. In this way, the injection is carried out directly into the oxidator flow which flows rounds the tube 19 and downstream of the tube 19 enters the mixer chamber 3 through the inlet opening 7.

Figure 12:
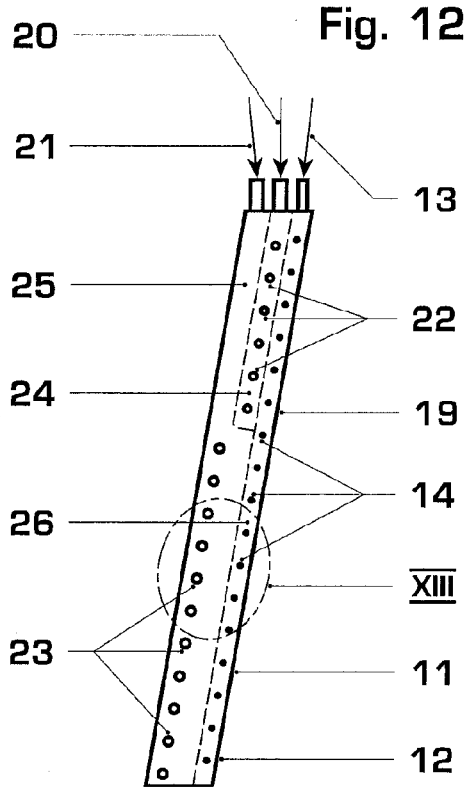
FIG. 12 shows a view of a detail XII from FIG. 8.
Figure 13:
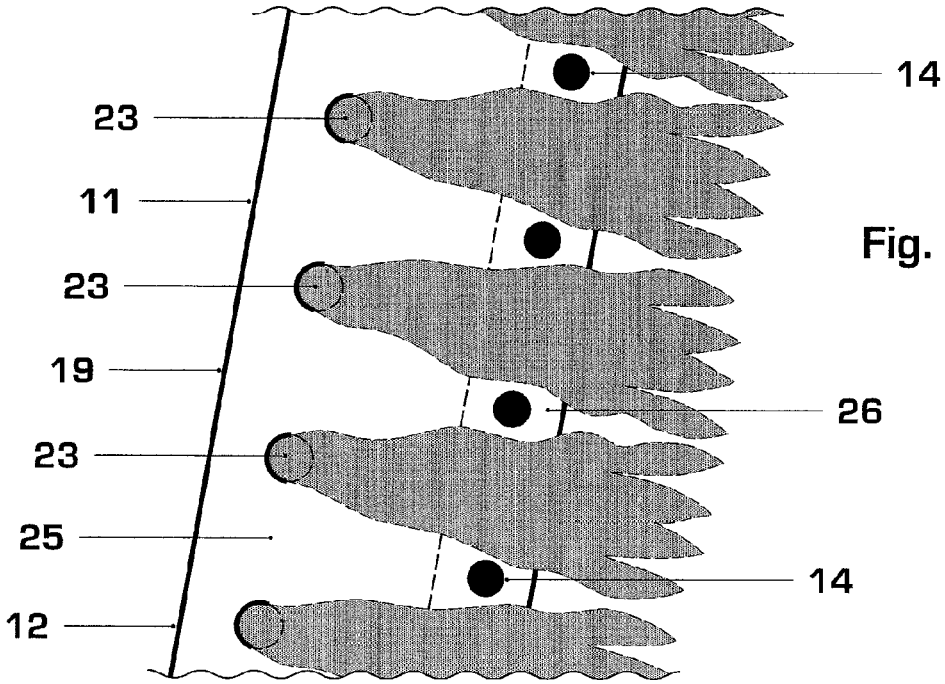
FIG. 13 shows an enlarged view of a detail XIII from FIG. 12.

Corresponding to FIGS. 12 and 13, the injection orifices 14, and the second injection orifices 23 which are formed on the same side of the tube 19, are arranged in an offset manner in relation to each other with regard to the main outflow direction 9 in order to avoid a mutual overlapping in this way. Correspondingly, it expediently also applies to the relative position between the injection orifices 14 and the first injection orifices 22. By the offset arrangement, for example, an ignitable mixture reaching the liquid fuel feed device 12 through the injection orifices 14 during operation of the burner 1 with gaseous fuel can be avoided.

LIST OF DESIGNATIONS

1 Burner
2 Housing
3 Mixer chamber
4 Burner head
5 Outlet opening
6 Lance
7 Inlet opening
8 Combustion space
9 Main outflow direction
10 Oxidator feed device
11 Gaseous fuel feed device
12 Liquid fuel feed device
13 Main feed line
14 Injection orifice
15 Main injection direction
16 Pilot feed line
17 Pilot injection orifice
18 Main outflow direction of 17
19 Tube
20 First feed line
21 Second feed line
22 First injection orifice
23 Second injection orifice
24 First gaseous fuel passage
25 Second gaseous fuel passage
26 Liquid fuel passage
27 Main inflow direction While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A premix burner for a combustion chamber of a gas turbine, the burner comprising:

a housing defining a mixer chamber configured and arranged to premix an oxidizer with a gaseous fuel, with liquid fuel, or with both;

an oxidizer feed device configured and arranged to feed oxidizer into the mixer chamber, the feed device having at least one inlet opening configured and arranged so that the oxidizer when fed through said at least one inlet opening to the mixer chamber flows tangentially into the mixer chamber;

a gaseous fuel feed device configured and arranged to feed gaseous fuel into the mixer chamber;

a liquid fuel feed device configured and arranged to feed liquid fuel into the mixer chamber;

an outlet opening in the housing configured and arranged to discharge oxidizer-fuel mixture from the mixer chamber into the combustion chamber;

wherein the liquid fuel feed device comprises a main feed line with a plurality of injection orifices for liquid fuel, and at least a majority of the injection orifices are configured and arranged so that a main injection direction of the injection orifices has a radial component which extends perpendicularly to a main outflow direction of the burner;

wherein a direction of the oxidizer-fuel mixture, when flowing from the mixer chamber at the outlet opening of the mixer chamber, is the main outflow direction of the burner;

wherein the liquid fuel feed device comprises an oval-shaped cross sectional streamlined tube configured and arranged to be flow-washed around by oxidizer flow.

2. The premix burner as claimed in claim 1, wherein the injection orifices are arranged in at least one row parallel to the main outflow direction.

3. The premix burner as claimed in claim 1, wherein the injection orifices main injection direction additionally includes an axial component in the direction of the main outflow direction; or wherein the injection orifices main injection direction additionally includes a tangential component; or both.

4. The premix burner as claimed in claim 1, wherein the liquid fuel feed device includes a pilot feed line with at least one pilot injection orifice for liquid fuel, and the at least one pilot injection orifice is configured and arranged so that a main injection direction of the pilot injection orifice exclusively has an axial component parallel to the main outflow direction.

5. The premix burner as claimed in claim 1, further comprising:

a burner head, and wherein:

the liquid fuel feed device comprises a centrally arranged lance which extends from the burner head into the mixer chamber, the lance having the at least one pilot injection orifice, or at least some of the injection orifices, or having both.

6. The premix burner as claimed in claim 1, wherein the liquid fuel feed device injection orifices are at least partially arranged inside or upstream of the housing inlet opening.

7. The premix burner as claimed in claim 1, wherein:

a set of the injection orifices are configured and arranged so that a main injection direction of the injection orifice of the set extends parallel to the main inflow direction of the oxidizer flow when flowing into the mixer chamber; or a set of the injection orifices are configured and arranged so that a main injection direction of the injection orifice of the set has a transverse component which extends at least approximately perpendicularly to the main inflow direction of the oxidizer flow when flowing in the inlet opening.

8. The premix burner as claimed in claim 1, wherein the tube has at least one liquid fuel passage which feeds at least some of the injection orifices of the liquid fuel feed device.

9. The premix burner as claimed in claim 1, wherein the gaseous fuel feed device and the liquid fuel feed device are integrated into the tube.

10. The premix burner as claimed in claim 8, further comprising:

orifices for gaseous fuel formed in the tube;

at least one feed line for the gaseous fuel; and at least one gaseous fuel passage formed in the tube parallel to the at least one liquid fuel passage, the at least one gaseous fuel passage in fluid communication with the gaseous fuel injection orifices and connected to the at least one feed line for the gaseous fuel.

11. The premix burner as claimed in claim 10, further comprising:

a first group of gaseous fuel injection orifices;

a first feed line in fluid communication with the first group of gaseous fuel injection orifices;

a first gaseous fuel passage connected to the first feed line formed in the tube parallel to the liquid fuel passage;

a second group of gaseous fuel injection orifices;

a second feed line in fluid communication with the second group of gaseous fuel injection orifices; and a second gaseous fuel passage connected to the second feed line formed in the tube parallel to the liquid fuel passage.

12. The premix burner as claimed in claim 11, wherein the second group of gaseous fuel injection orifices is arranged downstream of the first group of gaseous fuel injection orifices relative to the main outflow direction.

13. The premix burner as claimed in claim 12, wherein the first and second groups of gaseous fuel injection orifices are arranged in at least one row on the surface of the tube.

14. The premix burner as claimed in claim 13, the rows of liquid fuel feed device injection orifices, the first group of gaseous fuel injection orifices, and the second group of gaseous fuel injection orifices, are arranged along the longitudinal axis of the tube, or are arranged offset relative to each other over the tube circumference, or both.

* * * * *